United States Patent [19]

Simonson

[11] Patent Number: 4,979,847

[45] Date of Patent: Dec. 25, 1990

[54] RIDGE MULCHER

[76] Inventor: David L. Simonson, Box 429, Outlook, Saskatchewan, Canada, S0L 2N0

[21] Appl. No.: 369,759

[22] Filed: Jun. 23, 1989

[30] Foreign Application Priority Data

Jan. 30, 1989 [CA] Canada ..... 589594

[51] Int. Cl.[5] ..... E01C 23/12

[52] U.S. Cl. ..... 404/90; 404/92; 172/66

[58] Field of Search ..... 299/39; 404/90, 96, 404/98, 92; 172/66

[56] References Cited

U.S. PATENT DOCUMENTS

| | | | |
|---|---|---|---|
| 2,397,782 | 4/1946 | Flynn | 404/92 X |
| 2,787,943 | 4/1957 | Browning | 299/39 X |
| 2,905,456 | 9/1959 | Rafferty et al. | 299/39 |
| 3,409,088 | 11/1968 | Lindbeck et al. | 404/90 X |
| 3,547,492 | 12/1970 | Binger | 299/39 |

FOREIGN PATENT DOCUMENTS

| | | | |
|---|---|---|---|
| 593054 | 5/1959 | Italy | 404/90 |

OTHER PUBLICATIONS

Seaman Motors Brochure, "The Seaman Pulvi Mixer", 9-1943.

*Primary Examiner*—Ramon S. Britts
*Assistant Examiner*—David J. Bagnell
*Attorney, Agent, or Firm*—George H. Dunsmuir

[57] ABSTRACT

An apparatus for pulverizing and spreading the gravel ridge formed by plowing the shoulder portion of a gravel road onto the travelled portion thereof includes a frame for towing behind a vehicle, vertically adjustable rear wheels on the frame, and a pair of hydraulically driven, transversely extending, blade carrying drums. By towing the frame along a gravel road while rotating the drums, the paddle-like blades pulverize and spread the gravel ridge.

3 Claims, 4 Drawing Sheets

RIDGE MULCHER

BACKGROUND OF THE INVENTION

This invention relates to an apparatus for levelling the ground, and in particular for an apparatus for use in levelling ridges on gravel roads.

It is common practice when resurfacing gravel roads to reclaim the gravel from the shoulders of the road. During the reclaiming process, gravel and sod are plowed onto the road from the shoulders. A need exists for a machine to pulverize the gravel and sod ridges formed on the road.

The object of the present invention is to meet the above defined need by providing a relatively simple apparatus for levelling a road, and in particular for pulverizing a ridge formed on a road, so that only loose grass and gravel remain.

BRIEF SUMMARY OF THE INVENTION

Accordingly, the present invention relates to a gravel ridge pulverizing apparatus comprising frame means; wheel means carrying said frame means for movement along the ground; rotatable drum means carried by said frame means, blade means extending out of said drum means; drive means for rotating said drum means and consequently said blade means for pulverizing a ridge during passage of the apparatus over the ground; and lift means for adjusting the height of said blade means, whereby the depth of cut of said blade means can be varied.

BRIEF DESCRIPTION OF THE DRAWINGS

The invention will be described in greater detail with reference to the accompanying drawings which illustrate a preferred embodiment of the invention, and wherein.

Figure 1:
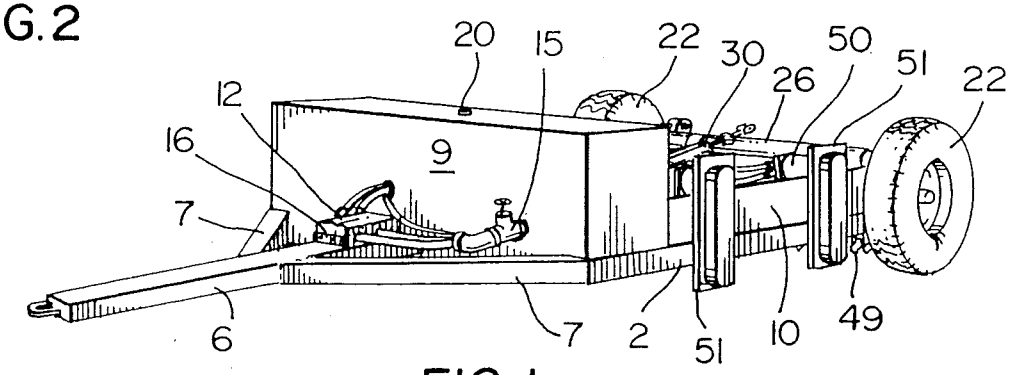
FIG. 1 is a perspective view from the front and one side of an apparatus in accordance with the present invention.
Figure 2:
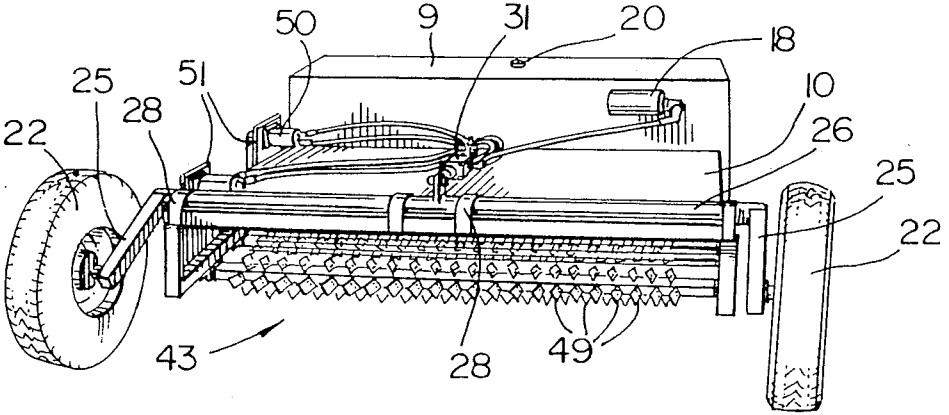
FIG. 2 is a perspective view from the rear of the apparatus of FIG. 1.
Figure 3:
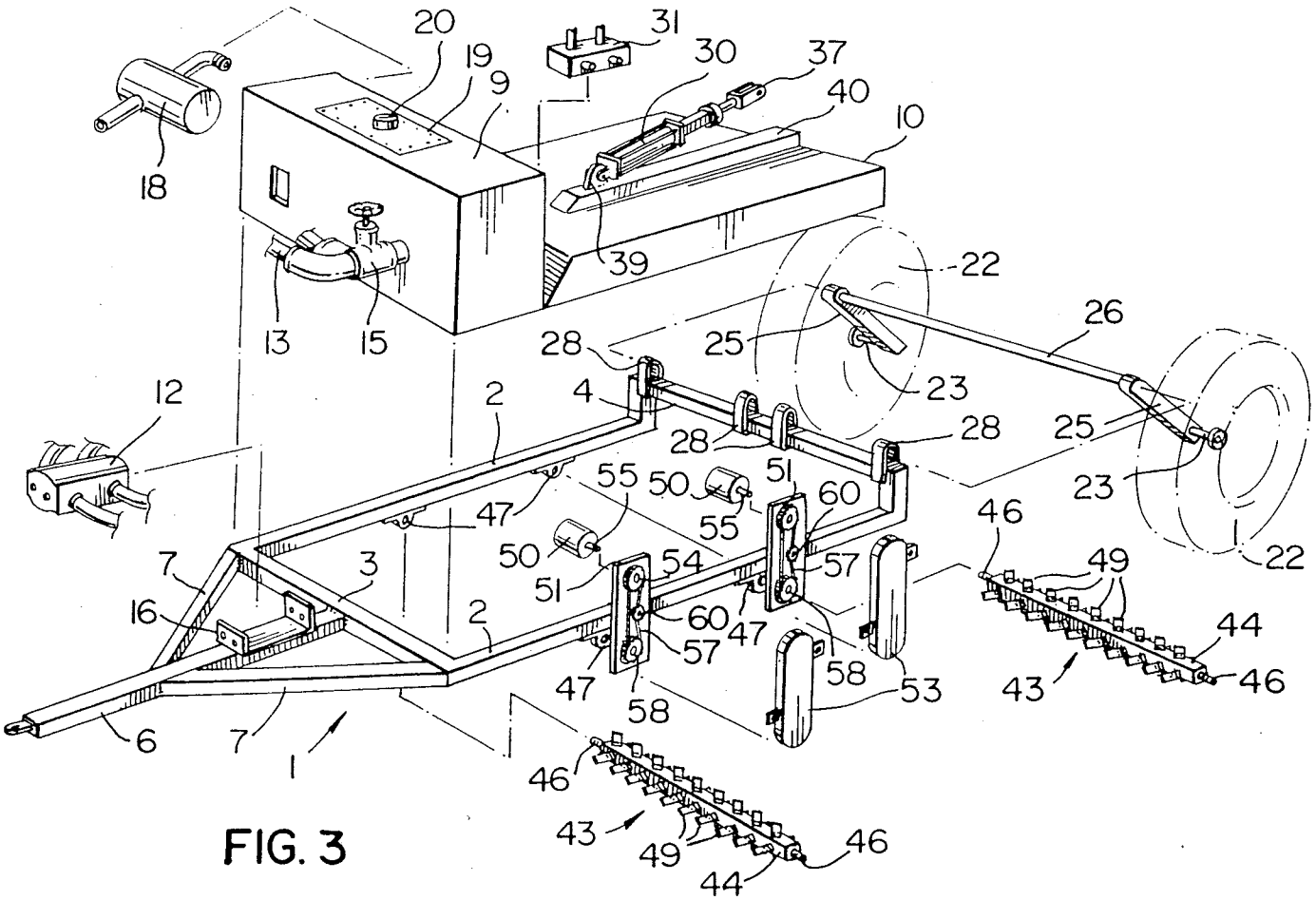
FIG. 3 is an exploded, perspective view of the apparatus of FIGS. 1 and 2.
Figure 4:
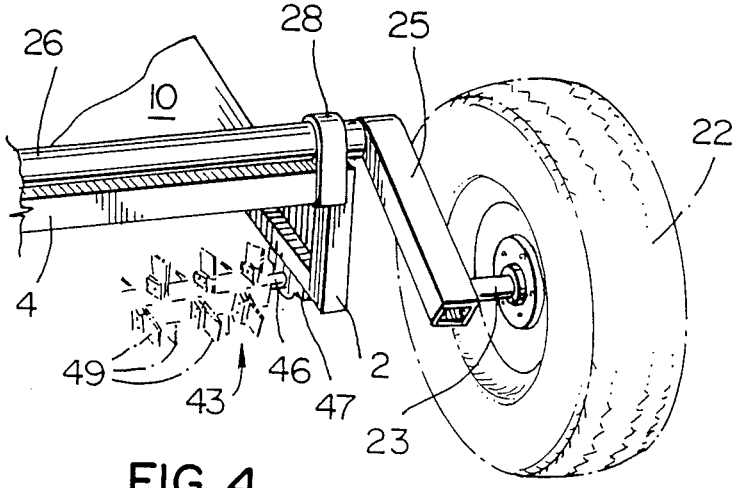
FIG. 4 is a perspective view of one rear corner of the apparatus of FIGS. 1 and 2 on a larger scale.

It should be noted that for the sake of simplicity parts have been omitted from some figures of the drawings.

DESCRIPTION OF THE PREFERRED EMBODIMENT(S)

With reference to the drawings, the apparatus of the present invention includes an elongated skeletal frame generally indicated at 1 defined by generally L-shaped sides 2 interconnected by a front crossbar 3 and a rear crossbar 4. A tow bar 6 extends outwardly from the front crossbar 3 for connecting the apparatus to a tractor or other towing vehicle (not shown). The tow bar 6 is reinforced by diagonal braces 7.

The frame 1 carries a hydraulic fluid reservoir 9 and a cowl or shield 10. The reservoir 9 is connected to a pump 12 mounted on the tow bar 6 by pipes 13 equipped with a valve 15. The pump 12 is mounted in a bracket 16 on the tow bar 6. The pump 12 is also connected to a filter 18 on the rear of the reservoir 9. A service cover

19 and a reservoir filling cap 20 are provided on the reservoir 9.

The rear end of the frame 1 is supported by a pair of wheels 22. The wheels 22 are mounted on stub axles 23, which are carried by a pair of arms 25. The top ends of the arms 25 are interconnected by a shaft 26 extending across the rear end of the apparatus. The shaft 26 is pivotally mounted on the rear crossbar 4 by means of inverted U-shaped straps 28, the ends of which are welded to the crossbar 4.

Figure 5:
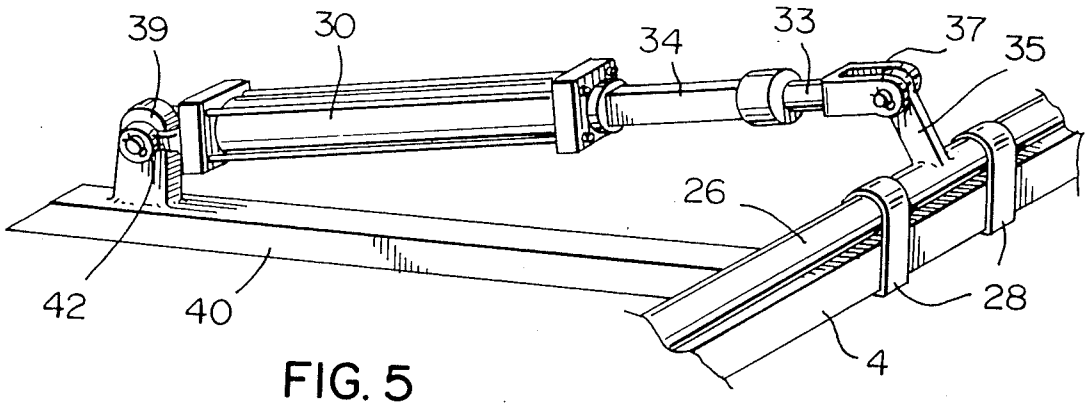
FIG. 5 is a perspective view of a hydraulic cylinder used to raise and lower the rear end of the apparatus of FIGS. 1 and 2.

The shaft 26 is rotated by means of a hydraulic cylinder 30, which is connected to the tractor 9. A piston rod 33 extends rearwardly out of a square cross section extension tube 34 (FIG. 5) on the cylinder 30 and is connected to a lug 35 on the shaft 26 by a clevis 37. The other end of the cylinder 30 is pivotally connected to a lug 39 on a reinforcing bar 40 on the cowl 10 by a clevis 42.

A pair of rotary cutters generally indicated at 43 are mounted beneath the frame 1. The cutters 43 include a drum 44 with a shaft 46 extending out of each end thereof into pillow block bearings 47 mounted on the bottom of each side 2 of the frame 1. Replaceable blades 49 extend out of the drum 44 along substantially the entire length thereof. Blades are mounted at a slight angle to allow mixing of material. The drum 44 is rotated by a drive mechanism, which includes a pair of hydraulic motors 50 mounted on plates 51 extending upwardly from the sides 2 of the frame 1. The motors 50 are connected to transmissions in casings 53 on the plates 51. Each transmission includes a gear 54 mounted on the shaft 55 of a motor 50. The gear 54 carries an endless chain 57 which extends around a gear 58 mounted on the outer end of the shaft 46. The chain 57 is tensioned by a third gear 60.

In operation, the depth of cut of the blades 49 is adjusted by extending or retracting the piston rod 33 to rotate the shaft 26, and consequently the arms 25. With the drums 43 rotating, the apparatus is towed along the road to pulverize a ridge of gravel created by plowing gravel from the shoulders of the road into the travelled portion thereof. The drums 44 are rotated opposite to direction of travel to lift material from the road.

It is worth noting that pressure relief valves (not shown) are incorporated into the hydraulic system to ensure that the drums 44 stop rotating if the cutters encounter a large rock. This arrangement prevents damage to the machine. Check valves (not shown) are incorporated into the hydraulic system, so that when the power takeoff portion of the drive is disengaged, the drums 44 will slowly rotate to a stop. The reservoir 9 is in the form of a one hundred gallon tank for cooling the hydraulic system while providing operating fluid.

What I claim is:

1. Apparatus for pulverizing, mixing and leveling the material of gravel and sod ridges formed on a gravel road by the operation of reclaiming gravel from the shoulders of the road, said apparatus comprising towable frame means, wheel means supporting said frame means for towed travel along the ground, tow bar means at one end of the frame means for connecting the apparatus to a towing vehicle, said wheel means being mounted at the other end of said frame means, two horizontal rotatable drum means carried by said frame means serially in the direction of travel, a multiplicity of blades extending out of said drum means and oriented about their axes at oblique angles relative to their direction of movement to effect mixing of the materials of the ridges while simultaneously pulverizing and leveling the materials, hydraulic motor means for rotating said drum means and consequently said blades opposite to the direction of travel of the apparatus for pulverizing, mixing and leveling a said ridge during travel of the apparatus over a ridge-bearing gravel road, lift means for adjusting the height of said blade-carrying drum means and hence the level of operation of said obliquely oriented blades, and a hydraulic power source drivable from a towing vehicle for supplying said hydraulic motor means, said apparatus being devoid of any air-aspirating internal combustion power source.

2. An apparatus according to claim 1, wherein said lift means includes arm means carrying said wheel means pivotally connected to said other end of said frame means for rotation around a horizontal axis for raising or lowering said wheel means.

3. An apparatus according to claim 2, including fluid actuated cylinder means and piston rod means connecting said arm means to said frame means for rotating said arm means around the horizontal axis and for retaining said arm means in one position.

* * * * *